US005564594A

United States Patent [19]

Monfredo

[11] Patent Number: 5,564,594

[45] Date of Patent: Oct. 15, 1996

[54] AUTOMATIC HOT FOOD DISPENSER USING ONE OR MORE MICROWAVE OVENS

[76] Inventor: Andre Monfredo, Le Mas F-26230, Grigan, France

[21] Appl. No.: 170,334

[22] PCT Filed: Jun. 29, 1992

[86] PCT No.: PCT/FR92/00609

§ 371 Date: Aug. 12, 1994

§ 102(e) Date: Aug. 12, 1994

[87] PCT Pub. No.: WO93/01569

PCT Pub. Date: Jan. 29, 1992

[30] Foreign Application Priority Data

Jul. 1, 1991 [FR] France ..... 91/08423
Mar. 2, 1992 [FR] France ..... 92/02682

[51] Int. Cl.[6] ..... A24F 27/14

[52] U.S. Cl. ..... 221/150 A; 99/357

[58] Field of Search ..... 221/150 A, 150 R; 99/327, 357; 219/700, 762, 701

[56] References Cited

U.S. PATENT DOCUMENTS 5,144,879 1/1992 Alessi ..... 221/150 A
5,168,795 12/1992 Okada ..... 221/150 A

FOREIGN PATENT DOCUMENTS 3269798 12/1991 Japan ..... 221/150 A

*Primary Examiner*—Kenneth Noland
*Attorney, Agent, or Firm*—Michael D. Bednarek; Kilpatrick & Cody

[57] ABSTRACT

Automatic hot food dispenser comprising storage columns (11; 45; 65) dimensionnally adjustable for receiving commestible products (14; 42; 79), fixed in the upper portion of the dispenser; in the frame middle portion (16) of the dispenser, one or more hoppers (17, 18; 40, 47; 68) located under the columns (11; 45; 65) collect the commestible products (14; 42; 79) and route them to an access hatch (19, 20; 43, 80) of one of the microwave ovens (21, 22; 44, 48; 90, 91); said microwave oven is provided with an ejection system (23, 24; 51, 61); the commestible product (14; 42; 79) is evacuated on a conveyor (25; 71) to the receptacle (5; 88) for the consumer; the cutlery ejector (89) evacuates a cutlery box (97) into the receptacle (5; 88); the lower portion of the dispenser comprises an automat (27) and an electronic panel (73).

27 Claims, 15 Drawing Sheets

AUTOMATIC HOT FOOD DISPENSER USING ONE OR MORE MICROWAVE OVENS

The present invention relates to an automatic food dispenser. According to a preferred embodiment, the automatic dispenser is peculiar to precooked food using one or more microwave ovens.

The prior art can be defined by the following patents:

FR-A-2 597 239: "This invention relates to a dispenser assembly for hot food preserved at low temperature, under vacuum, sterilized and the like, and served hot in a fully automatized manner. It comprises an electronic section programmable by its keyboard, which is the "brain" of the dispenser, a refrigerated storage compartment for the food, and an automatic food conveyor device to take food from refrigerated storage to the microwave ovens to be reheated. The assembly according to the invention is more specifically directed to the automatic precooked hot food dispensation".

This device well defines the prior art. The fact that a bank of microwave ovens is put at disposal of the public is the main drawback. The microwave ovens have to comply to very severe safety rules. The fact that microwave ovens are useable by a large public creates problems. So, those ovens can be submitted to vandalism acts or bad uses.

FR-A-2 611 465: "This invention is directed to an automatic device for serving, in a hot or cold state, food contained in a sealed bag. This device comprises several storage cabinets, several microwave ovens, a conveyor system for conveying food from the stock to the ovens and a pay system. The dispenser can provide several choices of food but it is essentially characterized in that it serves sealed bags and not open air food, which results in a new storage architecture."

FR-A-2 556 859: "This invention is directed to a type of automatic dispenser for hot and cold meals, including an electronic command. It comprises four essential elements: a power compartment regrouping the electronics controlling the functions and the motor of the refrigerator; a dispensation compartment regrouping two microwave ovens which also can be used as cold output mode for providing a meal dispenser; a refrigerated compartment regrouping double rows of shelves for storing the food; and a group device for grasping the food, which comprises a shovel moving between two rows of food shelves. The invention can be advantageously used for providing hot and cold meal dispenser containing a great number of prepared and stocked food in a compact fashion, providing the optimum profit for the machine."

FR-A-2 458 851: "This invention concerns a directed temperature foodstuff dispenser for stocking foodstuffs that would be otherwise perishable. Those foodstuffs are reheated by a microwave oven at the time of their dispensation. The invention is directed to the industry of a quick consumation."

U.S. Pat. No. 3,866,755: "This document describes an automatic dispenser according to the preamble of claim 1."

The automatic hot food dispenser according to the invention aims to solve all those problems. Particularly, it allows to dispense hot food without public access to the microwave ovens.

The dispenser according to the invention provides many other advantages. The dispenser comprises food or commestible product columns fixed in a cabinet which in turn is fixed on the frame of the dispenser, the cabinet and the columns are adaptable to the products to dispense and are not specific of a particular product. The dispensation is performed by gravity for simplifying the mechanism. The dispenser comprises a perforating system that can perforate, if necessary, the sealed package of the commestible products in order that those products do not explode because of the compression of the vapor when they are heated, and asepticize the perforating needles after use. The dispenser can treat commestible products at room temperature, at positive cold, at negative cold. The dispenser comprises a programmable vendor. It can be connected to a microcomputer for the stock management and the after sale service.

The automatic dispenser according to the invention is of a type using means for stocking commestible products, one or more microwave ovens, guiding means for guiding food from the stock to the ovens and a command and pay system (coiner). The dispenser is characterized by the fact that it comprises modular cabinets that can be attached to the upper portion of the casing frame of the dispenser, said cabinets being provided with lugs used as a support that can be adapted to size-adjustable columns which receive the commestible products in the middle portion of the casing frame of the dispenser, one or more chutes collect the products and guide them on one or more inlet hatches up to a microwave oven; said microwave oven is provided with an ejection drawer or ejection slide that ejects the commestible product on a conveyor that conveys the product in front of an inlet window for the consumer, the lower portion of the casing frame comprises a programmable vendor, a command cabinet and an outlet connectable by modem to a microcomputer for the stock management and the after sale service.

In a preferred embodiment, the storage cabinet comprises eight columns above which are located two chutes giving an access to two microwave ovens.

The inlet hatch is located in the upper portion of the microwave oven and is pneumatic cylinder operated.

The microwave oven is provided with a bottomless slide the back wall of which is an inclined plane for receiving the commestible product that falls from the inlet hatch and for filling the office of an ejector rake when the slide operated by another pneumatic cylinder partially comes out of the oven enclosure for ejecting said commestible product on a conveyor.

The inlet window is equipped with an anti-break-in flap excluding public access to the conveyors and/or microwave ovens.

According to another embodiment, the chute is formed by transversal rolls that guide the commestible products to an inlet hatch of at least one microwave oven.

The inlet hatch of the oven is of the type letter box with horizontal hinge and a door hung on hooks which open with the impact of the product, falling by gravity from the chute, and the automatic closure by gravity of said hung door.

The ejector means for ejecting the commestible product out of the oven is a scraper as a vertical wall that delimits a corresponding space for receiving the commestible product, said scraper being interdependant with the outlet door of the oven with vertical hinge.

As soon as the door is open, the scraper drives the commestible product out of the oven, by means of its vertical wall, and lets it fall on a ball race (run-way) that drives it to the outlet and the access window for said product.

The outlet door of the oven is operated by an electromagnet and a return spring.

The microwave oven is provided with a perforating means for perforating the package of the commestible product.

The perforating means comprises articulated fingers interdependant with an axle operated by an electromagnet and a spring, the fingers being provided at their free end with at least one perforating needle.

Said fingers are of different sizes and independant from each other to adapt to the different shapes of the package.

According to a third embodiment, the chute is formed by transversal rolls and is provided with a tray tilting between the two microwave ovens. The commestible product is ejected from one of the storage columns and positioned on the tilting tray. The perforating system descends the needles for perforating the commestible product and ascends them in a standby position for sterilizing them by means of resistances. The tilting tray guides the commestible products to an inlet hatch of one of the microwave ovens according to their availability. The inlet hatch of the oven is of the letter box type with horizontal hinge, with a door opened by a motor. When the commestible product falls by gravity into one of the microwave ovens, the door closes again by means of the same motor. A tilting tray inside the oven is used as an ejector system by gravity for ejecting the commestible products out of the microwave oven, when lifting up, it pushes an evacuation door of the letter box type with horizontal hinge which is maintained closed by a spring. The commestible product slides on a conveyor to the receptacle for the consumers.

The appended drawings are indicative and not limitative. They illustrate a preferred embodiment of the invention. They provide an easy understanding of the invention.

Figure 1:
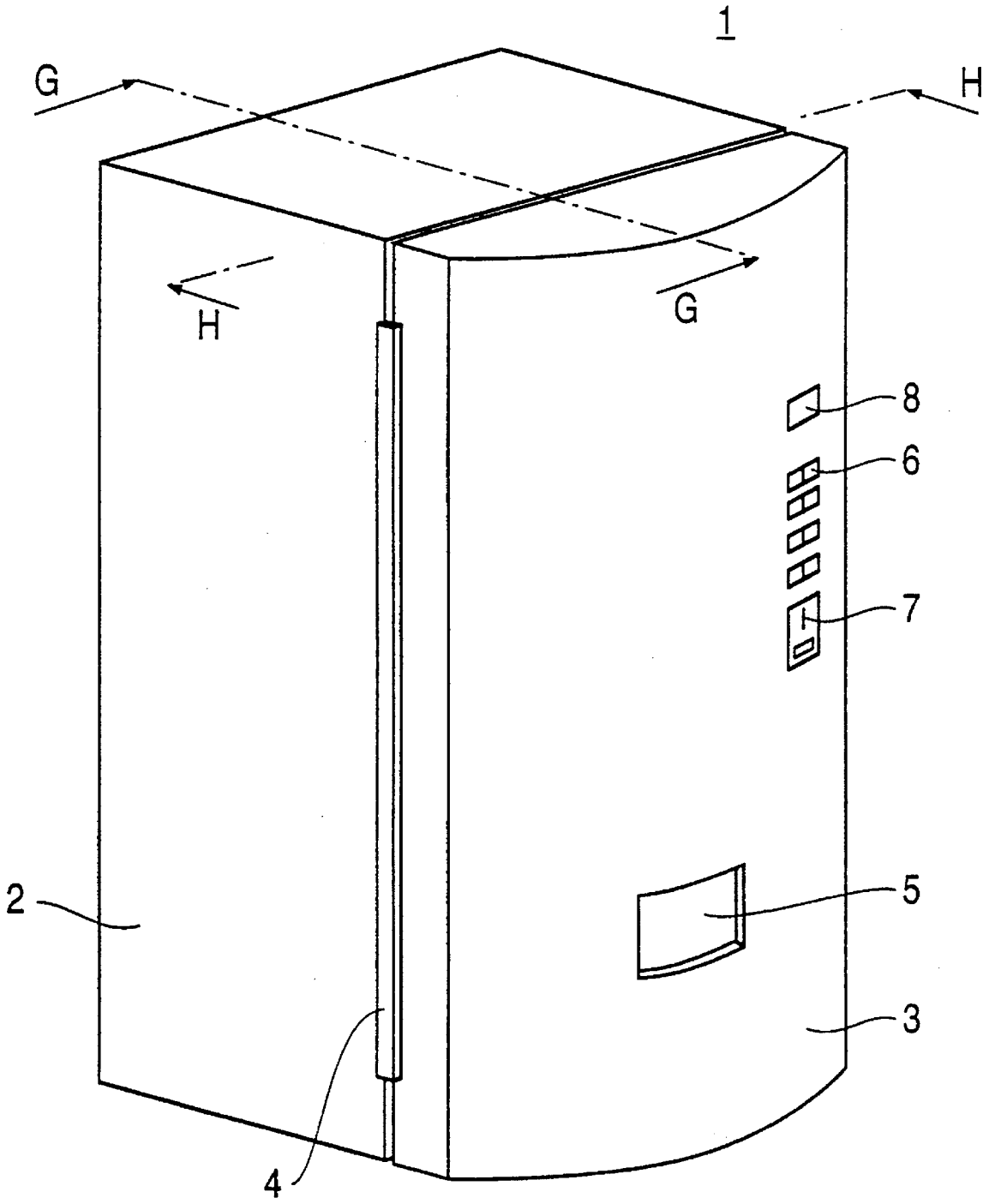
FIG. 1 is a perspective view of the dispenser according to the invention.
Figure 2:
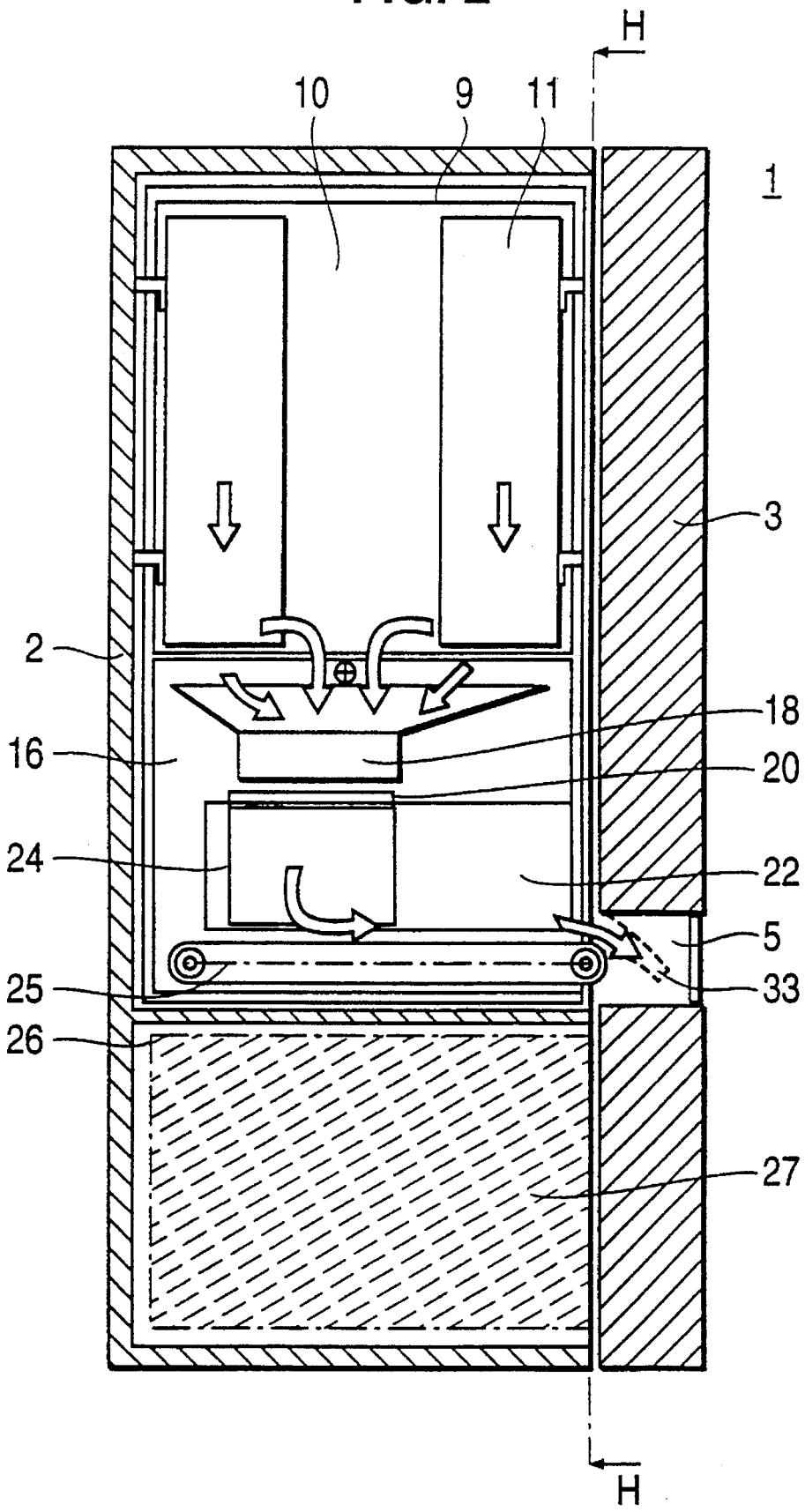
FIG. 2 is a cross-sectional view of the dispenser as viewed along a cross-sectional axis G—G illustrated in FIG. 1.
Figure 3:
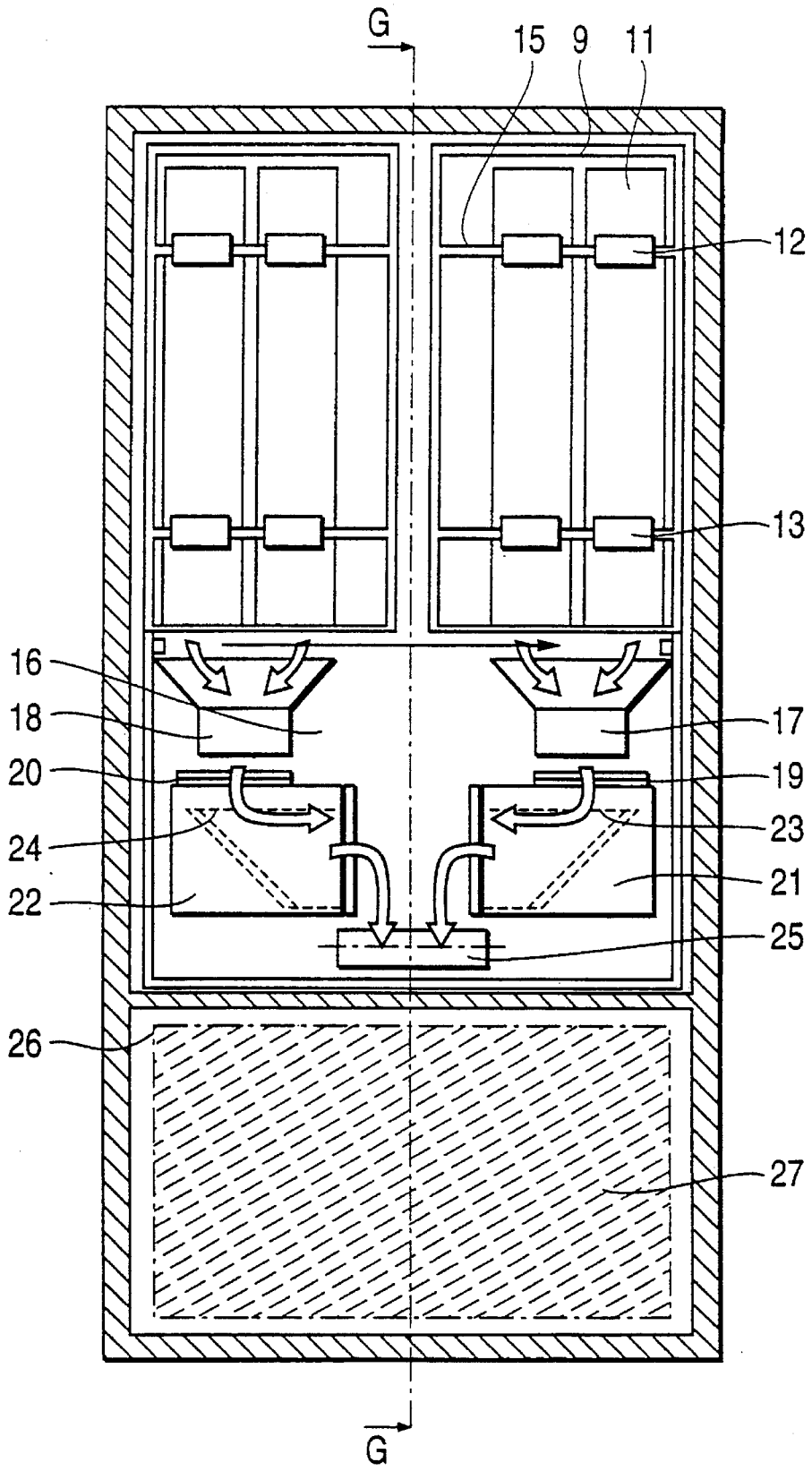
FIG. 3 is a cross-sectional view along an axis H—H illustrated in FIG. 2.
Figure 5:
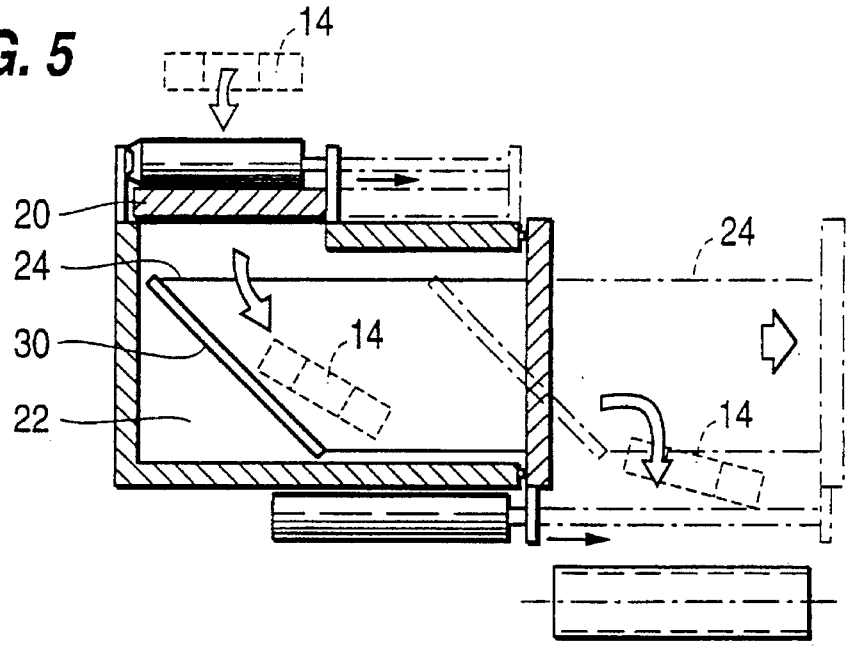
FIG. 5 is a longitudinal sectional view of a microwave oven and with dash dot lines, of the action of the ejection slide.
Figure 4:
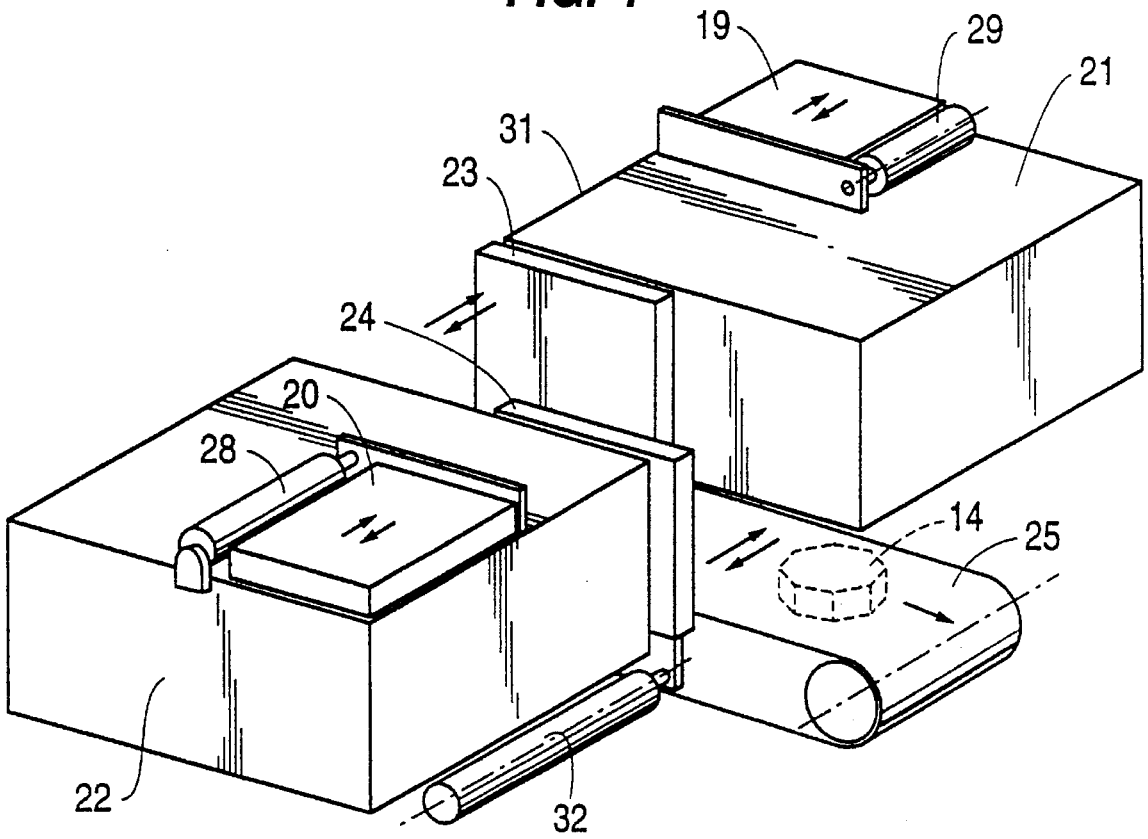
FIG. 4 is a perspective view of the microwave ovens setting out the movement of the inlet hatches, the ejection slides and the conveyor.
Figure 8:
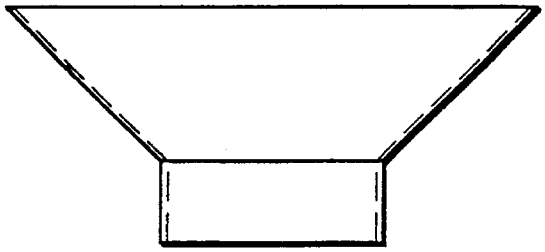
FIG. 6, 7 and 8 are respectively a side view, a top view and a front view of a chute according to the invention.
Figure 6:
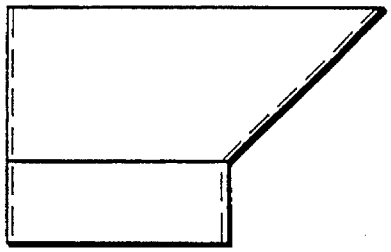
Figure 7:
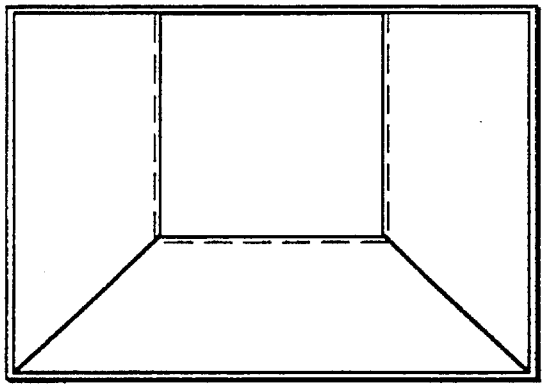
Figure 9:
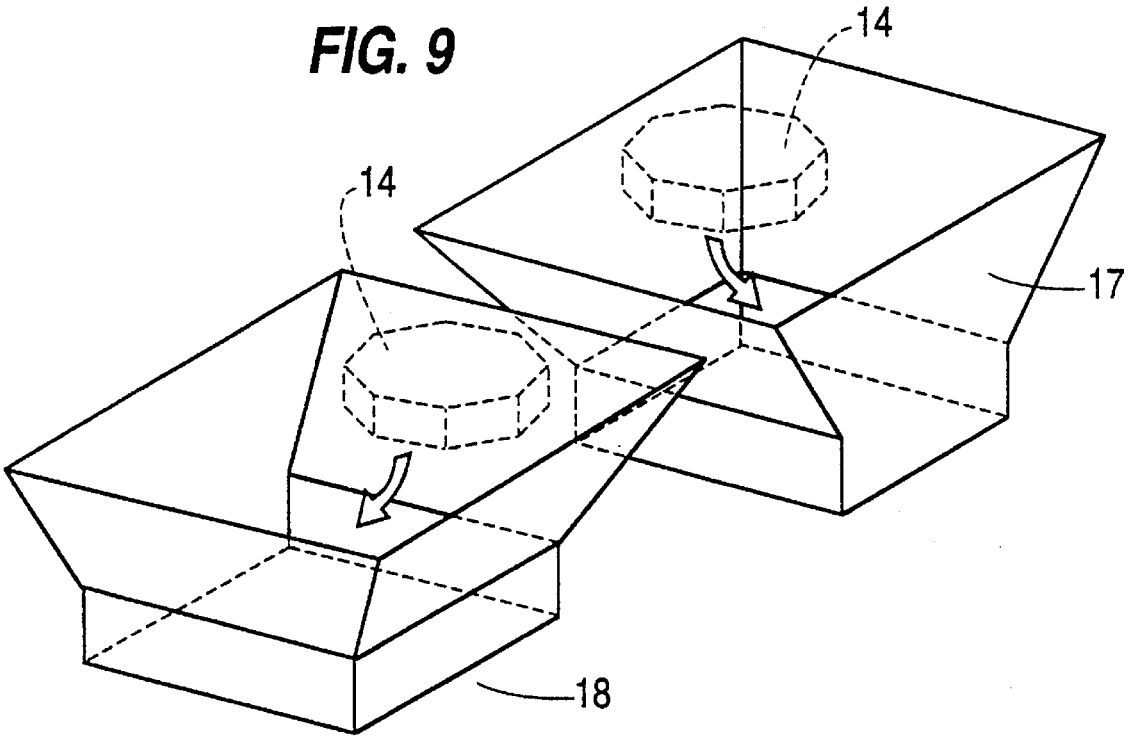
FIG. 9 is a perspective view of two chutes as located in the dispenser.

The dispenser 1 according to the invention is of the type using a storage means for storing commestible products 14, one or more microwave ovens 21, 22, guiding means for guiding food or commestible products from the stock to the oven and a command and pay system.

The dispenser 1 according to the invention, as shown in figures, is of the shape of casing frame 2, with a door 3 mounted on a hinge 4. This front door 3 comprises on its face an access window 5 allowing to the public to take off the selected commestible products. Select knobs 6 allow to the user to select the commestible product he desires. A coiner 7 allows the consumer to pay for the selected commestible products. A control screen 8 allows the user to follow each stage of preparation of the selected meal. It also permits the user operations to be guided.

In the embodiment illustrated in the figures, the dispenser 1 comprises two modular cabinets 9 that are fixed to the upper portion 10 of the casing frame 2 of the dispenser 1. The cabinets 9 are provided with transversal bearing bars 15 allowing the dispensation columns 11 to be fixed by means of holding upper lugs 12 and holding lower lugs 13 and to be hooked to the transversal bars 15 of the cabinets 9. Those columns 11, which are hooked to the transversal bearing bars 15 of the different cabinets 9, are adjustable and adapted to the specific commestible products 14 with which the dispenser 1 is supplied.

In the middle portion 16 of the casing frame 2 of the dispenser 1, two chutes or hoppers 17 and 18 are located under the dispensation columns 11 for collecting the commestible products 14 and directing each of them above an access hatch 19, 20 to a microwave oven 21, 22. Each microwave oven 21, 22 is provided with an ejection slide 23, 24 ejecting the commestible product 14 on a conveyor 25. The conveyor 25 conveys the commestible product 14 in front of the window 5 located on the front door 3. This access window 5 is for the consumer.

The lower portion 26 of the casing frame 2 of the dispenser 1 comprises a programmable automaton or computer 27. Besides, in this lower portion 26, while being not illustrated in the drawing, there is a command cabinet and an outlet connectable by means of a modem incorporated or not in the dispenser 1 to a microcomputer for the stock management and the after sale service.

In the embodiment illustrated in the figures, the cabinets 9 each comprise four columns, eight dispensation columns in all. Below these columns are located the two chutes 17 and 18 that allow an access to the two microwave ovens 21, 22. The access hatches 19 and 20 are located in the upper portion of the microwave ovens 21, 22. These access hatches 19 and 20 are operated by pneumatic cylinders 28 and 29. The microwave ovens 21 and 22 are each provided with ejection slides 23, 24. The ejection slides 23, 24 are bottomless slides the back portion of which is in the form of an inclined plane 30 for receiving the commestible product 14 which falls from the access hatch 19 and 20.

The ejection slide 23, 24 also fills the office of an ejector rake when it is operated by another pneumatic cylinder 31 or 32 which goes out or into the microwave oven enclosure 21 or 22, that for ejecting the commestible product 14 on the common conveyor 25 located between the two microwave ovens 21 and 22. The access window 5 is provided with an anti-break-in flap 33 excluding public access to the conveyor 25 and/or microwave ovens.

Figure 10:
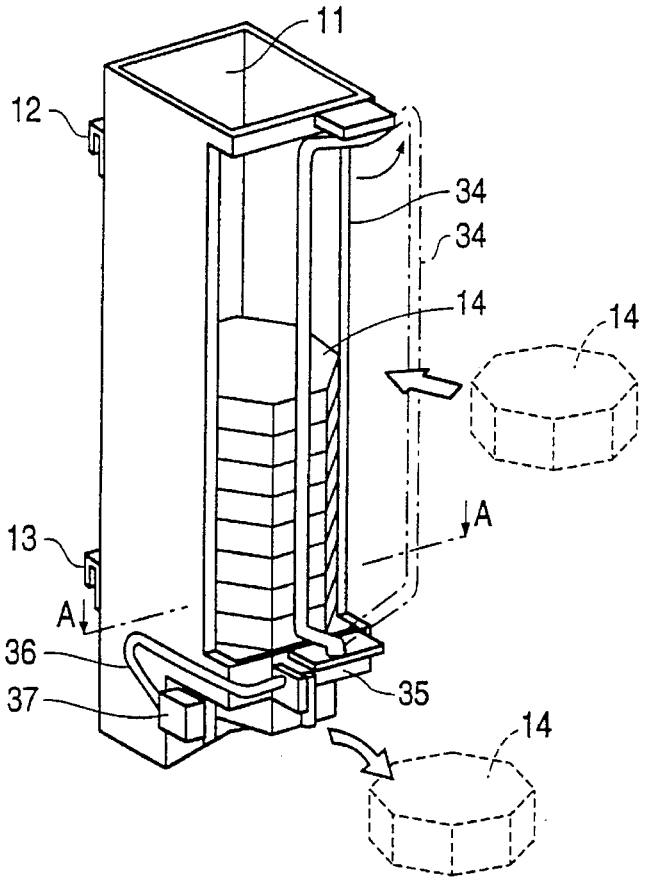
FIG. 10 is a perspective view of a column loaded with commestible products; it sets out its pivoting loading and holding bar and its dispensation device of each commestible product one by one.
Figure 11:
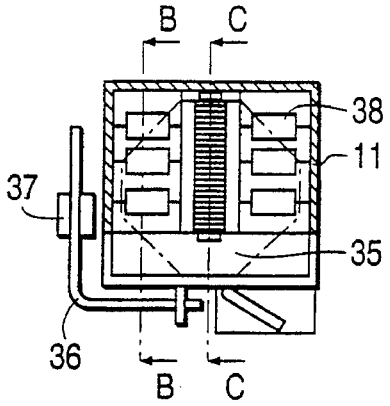
FIG. 11 is a cross-sectional view of the column along a transversal axis A—A illustrated in FIG. 10.
Figure 13:
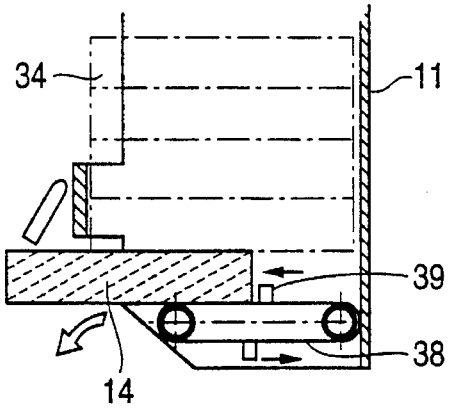
FIG. 13 is a cross-sectional view along an axis C—C illustrated in FIG. 11.
Figure 12:
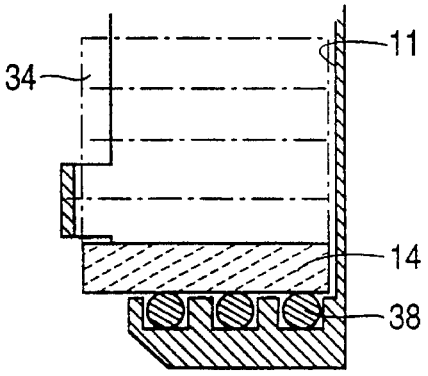
FIG. 12 is a cross-sectional view along an axis B—B illustrated in FIG. 11.
Figure 14:
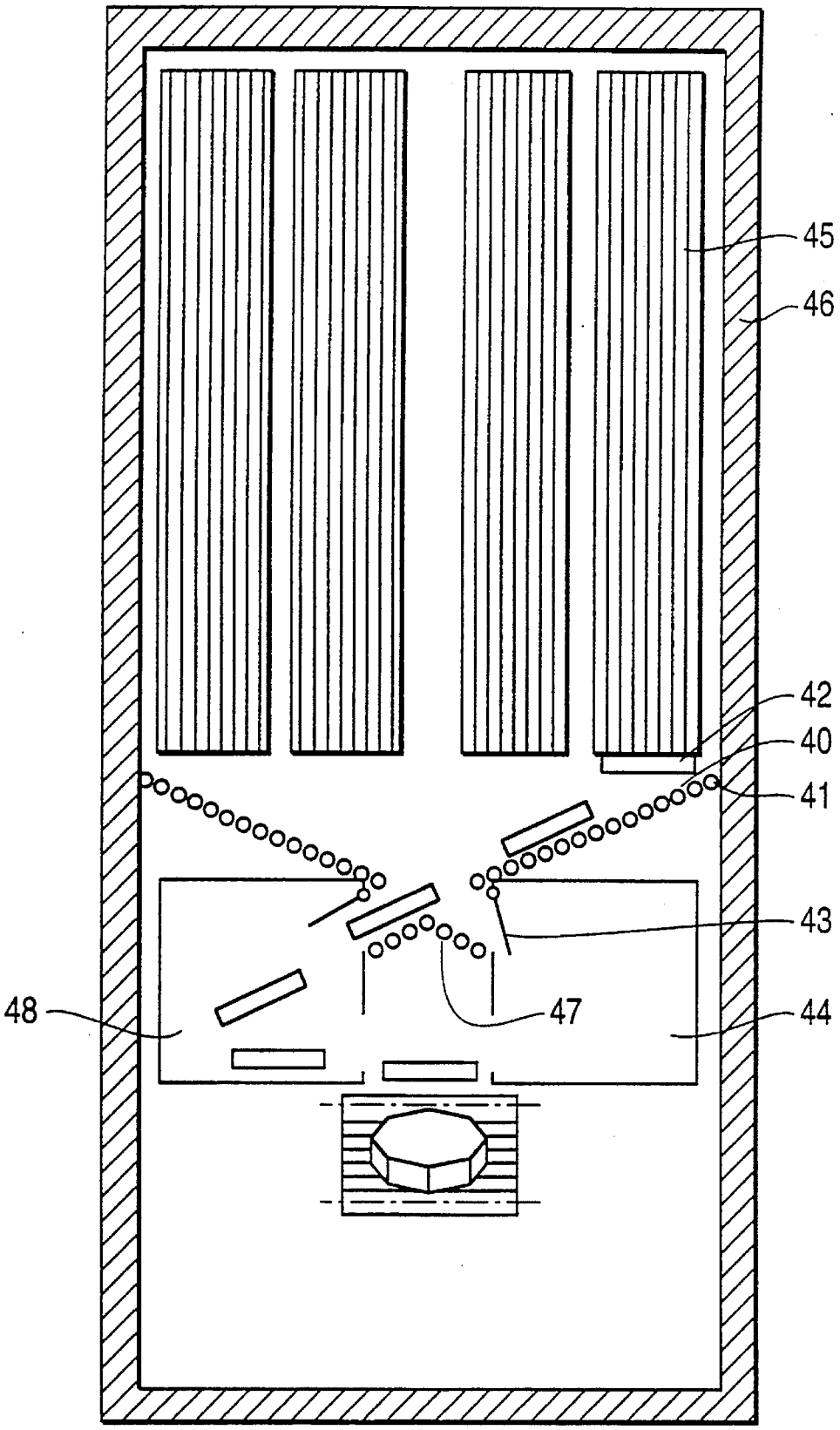
FIG. 14 is a schematic view of another embodiment in which the hatch is unique and is formed by transversal rolls; this view sets out the inlet and the outlet of the commestible product in the oven.
Figure 15:
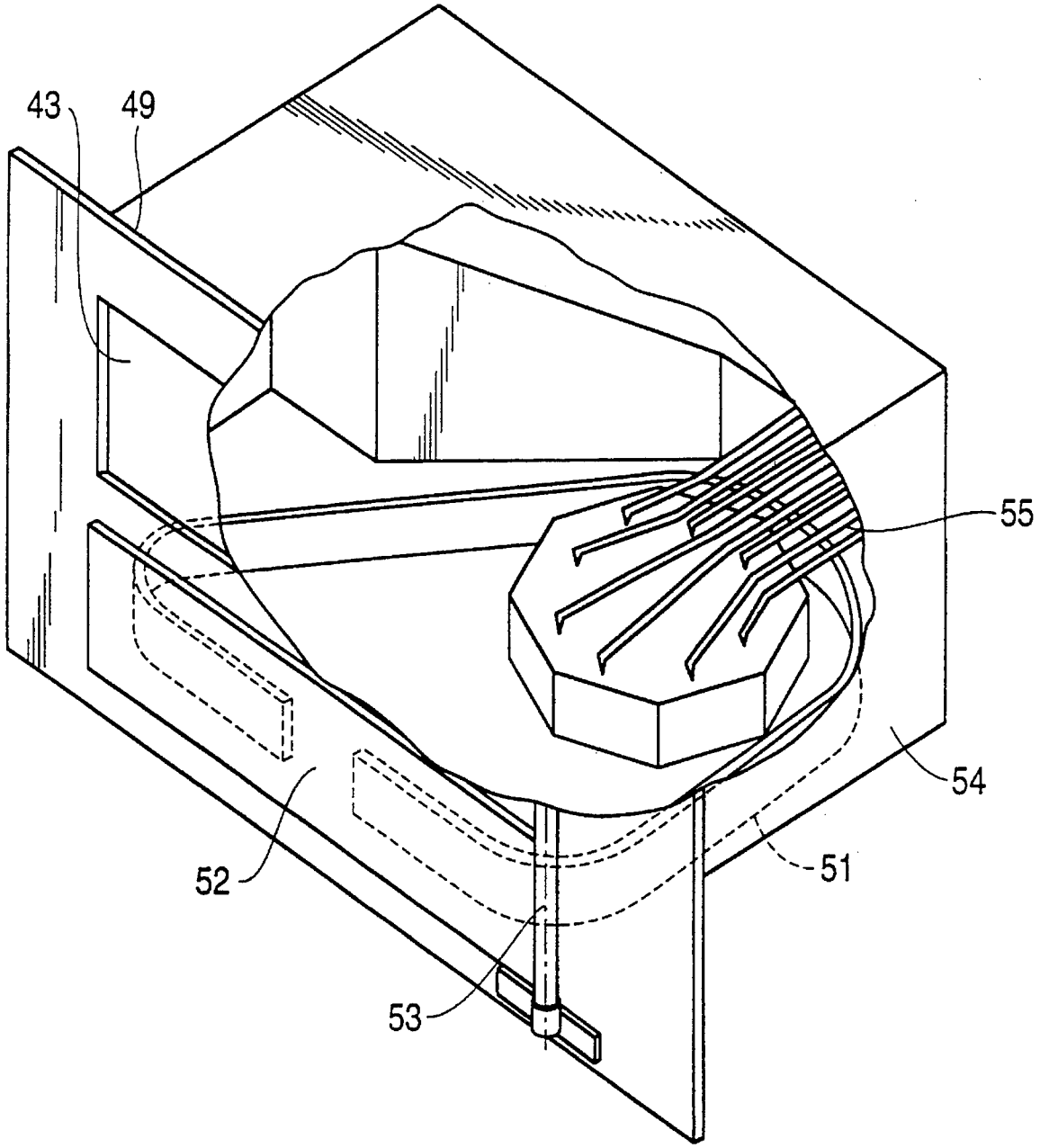
FIG. 15 is a schematic perspective view of the oven setting out the inlet door, the outlet door with its ejector means and the perforating means.
Figure 16:
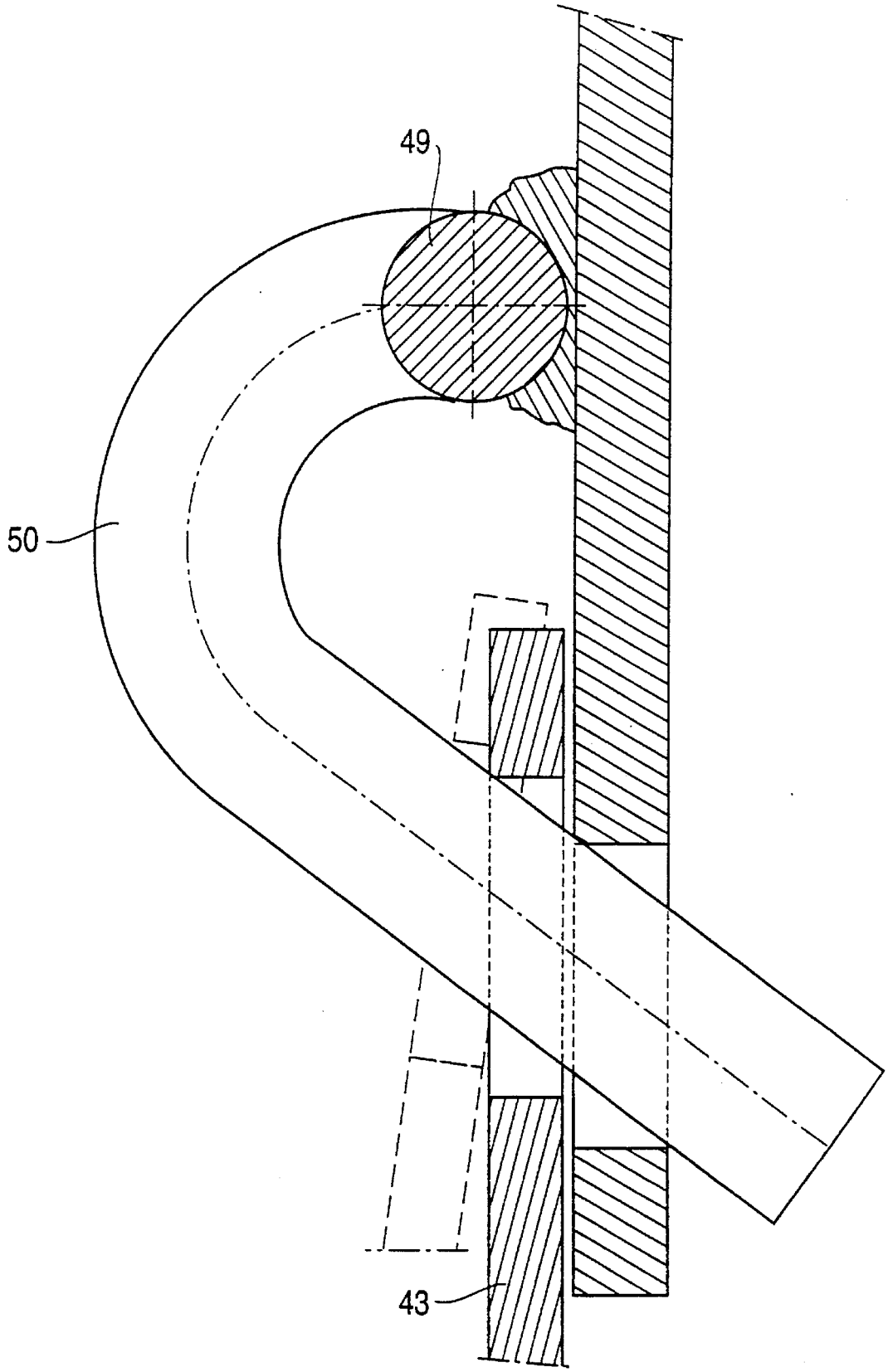
FIG. 16 is a schematic view of the hooks-hinges of the inlet door which is hung to the oven.
Figure 17:
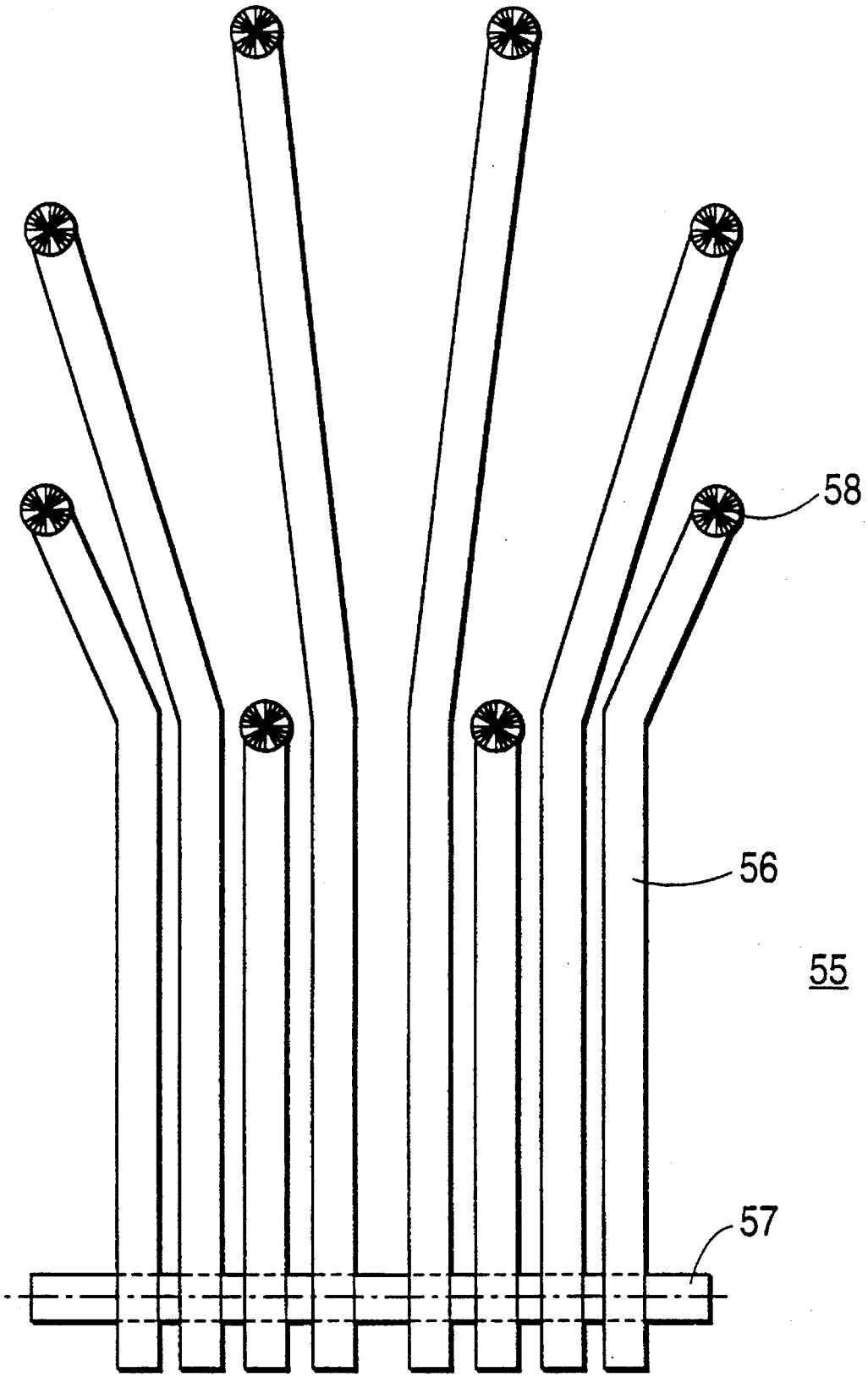
FIG. 17 is a plan view of the perforating means of the packages of the commestible products.

FIGS. 10, 11 or 12 and 13 set out the dispensation device of the storage columns 11 stocking the commestible product 14. FIG. 10 is a perspective view of a column 11. It particularly sets out the bar 34 which is a pivoting bar as shown with dash dot lines. This pivoting bar permits to liberate the front inlet of the column 11 for its loading with commestible products 14. In a closed position, the bar 34 permits to maintain the commestible products one above the other in the column 11.

In the bottom of the column 11, a dispensation device permitting the delivery of the commestible products 14 one by one is implemented.

The dispensation device of the column 11 comprises a flap 35 operated by a rod means 36 provided with a counter-weight 37.

In the purpose of disengaging the commestible product 14 to be dispensed, a conveyor 38 located in the lower portion of the column 11 permits to liberate the commestible product 14, the flap 35 being then open. The belt of the conveyor 38 is provided with an index 39 which drives with it the commestible product 14.

Because of its simplicity, this dispenser device provided into the lower portion of the bottom of the storage column 11 for stocking the commestible products 14 is of simple operation.

Referring to FIGS. 14–17, another embodiment will be described in which the chute or hopper 40 is formed by transversal rolls 41. The chute or hopper 40 forms a ball race which guides the commestible products 42 to an inlet hatch 43 of a microwave oven 44, 48.

The commestible products 42 are issued, as in the previous embodiment, from columns 45 which are attached to the housing 46 of the cabinet of the dispenser.

The chute 40 comprises a large cone opened at its apex, which is downwardly oriented and is terminated by another reversed cone 47, apex upwardly oriented, which delivers the commestible products 42, either to the right microwave oven 44, or to the left microwave oven 48.

The inlet hatch 43 of the microwave oven 44 or 48 is of the letter box type with a horizontal hinge 49. The inlet hatch 43 is a door hung on hooks 50 providing the opening of the inlet door 43 with the impact of the commestible product 42 on inlet door 43 after falling by gravity from the chute 40, 47. The inlet door 43 remounts on the hooks 50 while rotating and lifting itself by gravity. The closing of this hanged door 43 is automatic.

The ejector means 51 of the commestible product 42 of the microwave oven 44, 48 is a scraper 51 such as a vertical wall which delimits a corresponding space for receiving the commestible product 42.

The scraper 51 is integrated with the outlet door of the oven, door 52. This door comprises a vertical hinge 53. As soon as the oven outlet door 52 is operated, the scraper 51 drives the commestible product 42 out of the microwave oven 44, 48. The scraper 51, by means of its vertical wall, scrapes the bottom of the microwave oven 44 or 48 and drives out of the microwave oven 44, 48 the commestible product 42 when the door 52 is open. The outlet door 52 of the microwave oven 44, 48 is operated by an electromagnet and a return spring.

The shape of the scraper 51 is a function of the mean shape of the packages of the commestible products 42. Each microwave oven 44, 48 is provided with a perforating means 55 of the package of the commestible product 42.

The perforating means 55 comprises articulated fingers 56 interdependant with an axle 57 operated in rotation by an electromagnet and a spring (not shown in the figures). The fingers 56 are provided at their tip with at least one perforating needle 58.

The fingers 56 are of different sizes and independant from each other for accomodating different shapes of the packages of the commestible products 42. As soon as a block of the commestible products 42 falls in the oven, the programmed automaton drives an electromagnet and a return spring that operate on the perforating means 55 acting as a hand that comes down on the package of the commestible product 42 and by means of its fingers 56 and perforating needles 58, perforates the package. After this action, the perforating means lifts up by a return spring not shown in the figures. The assembly of the perforating means 55 forms a hand the fingers 56 of which may be straight, of different lengths, but the hand may also comprise fingers that, in a top view, form a fan, i.e they separate from each other in the last third of their length.

Figure 18:
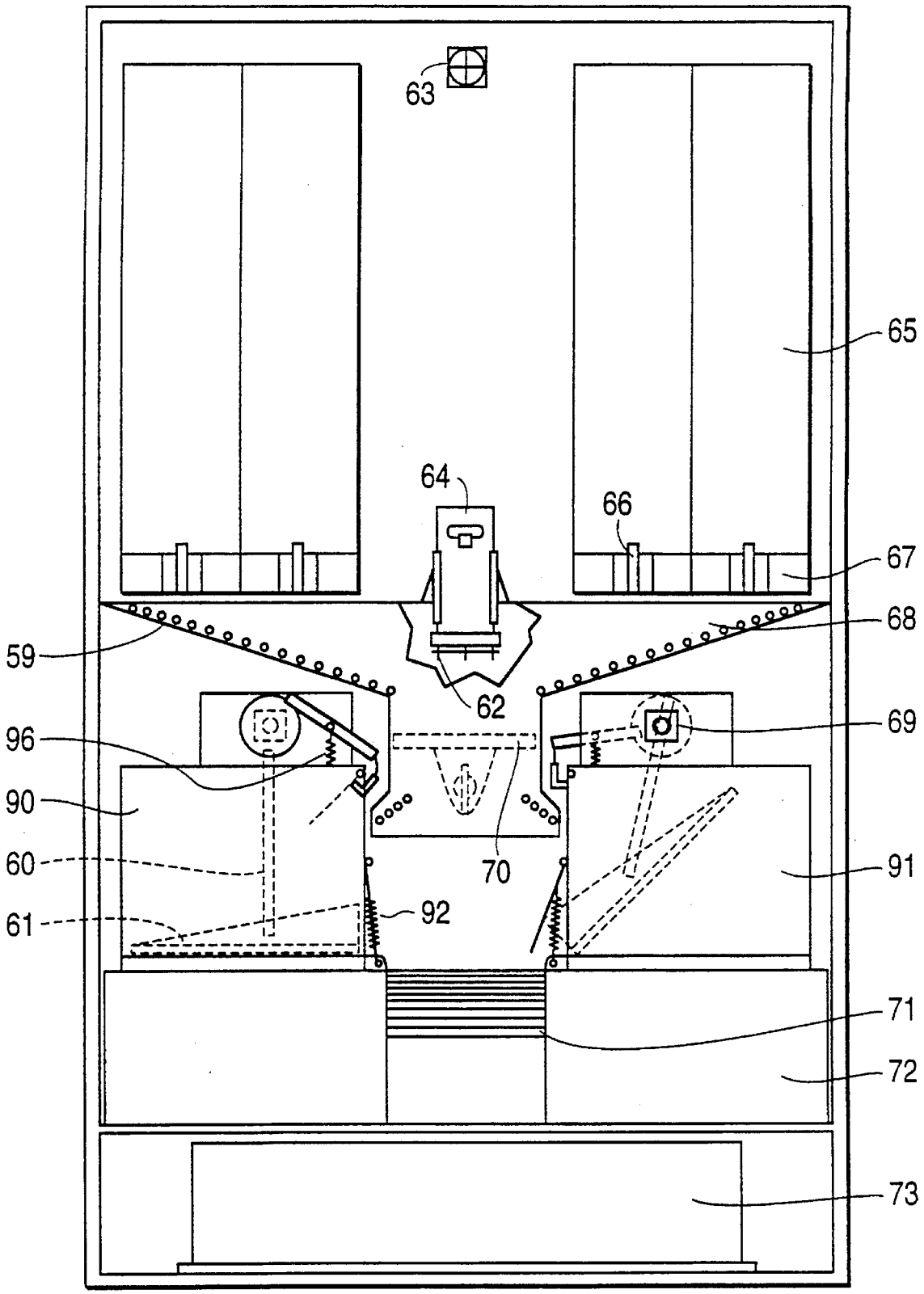
FIG. 18 is a schematic view of the operation mode according to a third embodiment in which the unique chute is provided with a tilting tray surmounted by the perforating system and the ovens are provided with a tilting tray; this view sets out the tilting tray of the chute, the perforating system, the oven inlet, the tilting tray of the oven and the oven outlet.

The dispenser shown in FIG. 18, according to a third embodiment of the invention, is of the type using a storage means for stocking commestible products 79, one or more microwave ovens 90, 91, routing means for routing food or commestible products from the stock to the oven and a command and pay system.

The dispenser according to the invention, as illustrated in the figures, is of the shape of a casing frame with a door mounted on a hinge. This front door comprises on its face an access window permitting to the public to take off the selected products. Select knobs allow to the user to select the commestible product he or she wishes. A coiner allows the consumer to pay for the selected commestible products. A control screen allows the user to know which stage the dispenser and its selected meal have reached. It also permits the user operations to be guided.

In the embodiment illustrated in the figures, the dispenser comprises in its upper portion four dispensation and storage double columns 65, i.e eight possible choices for the commestible products 79. These columns can be fixed by means of upper and lower supports 77. These dispensation and storage columns 65 which are hooked to the transversal bearing bars 77 are adjustable and adaptable to the specific commestible products 79 with which the dispenser is provided. The number of dispensation and storage columns 65 of the commestible products 79 can vary according to the needs.

Figure 19:
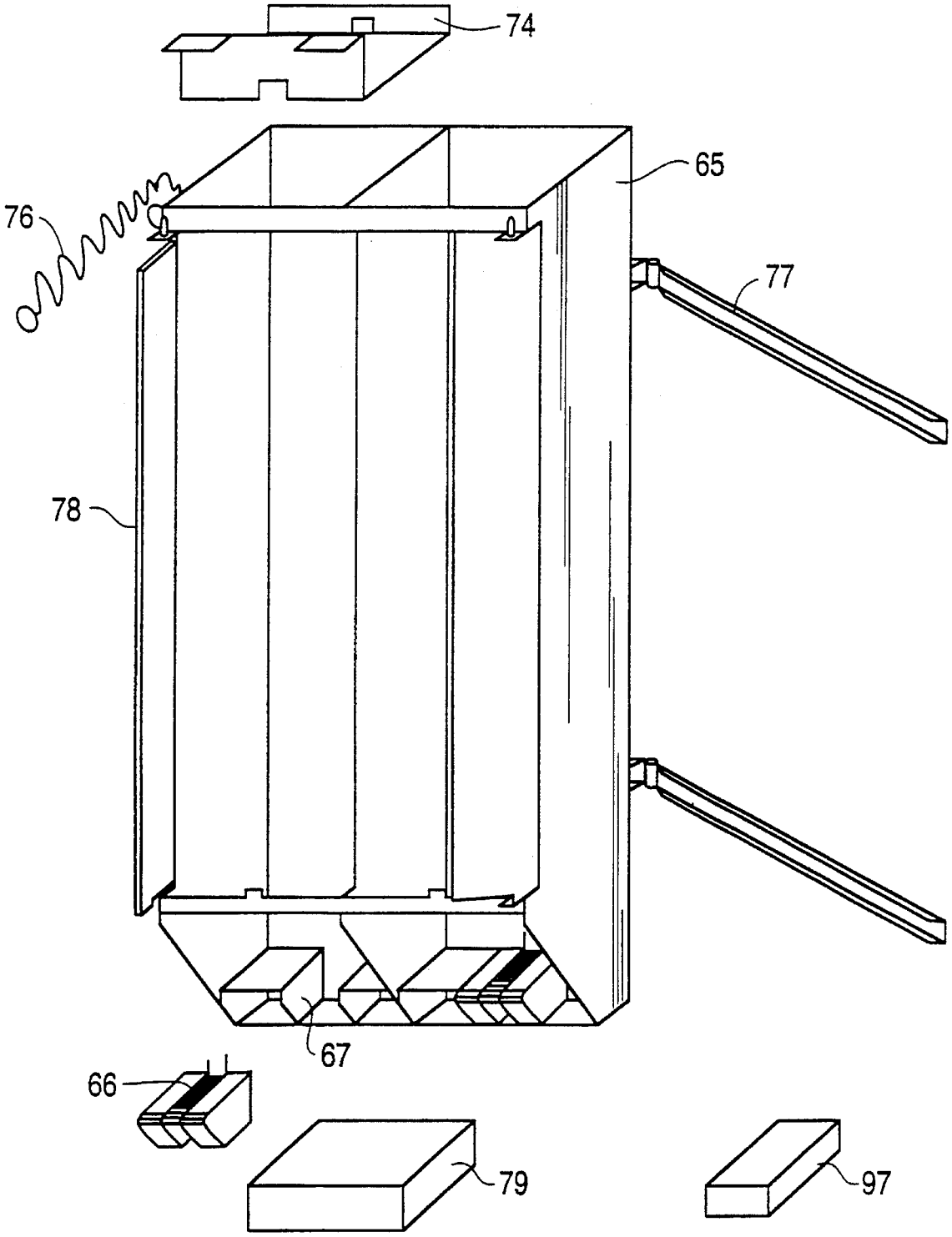
FIG. 19 is a schematic view of one of the storage columns; this view sets out the holding hinge system of the columns.
Figure 20:
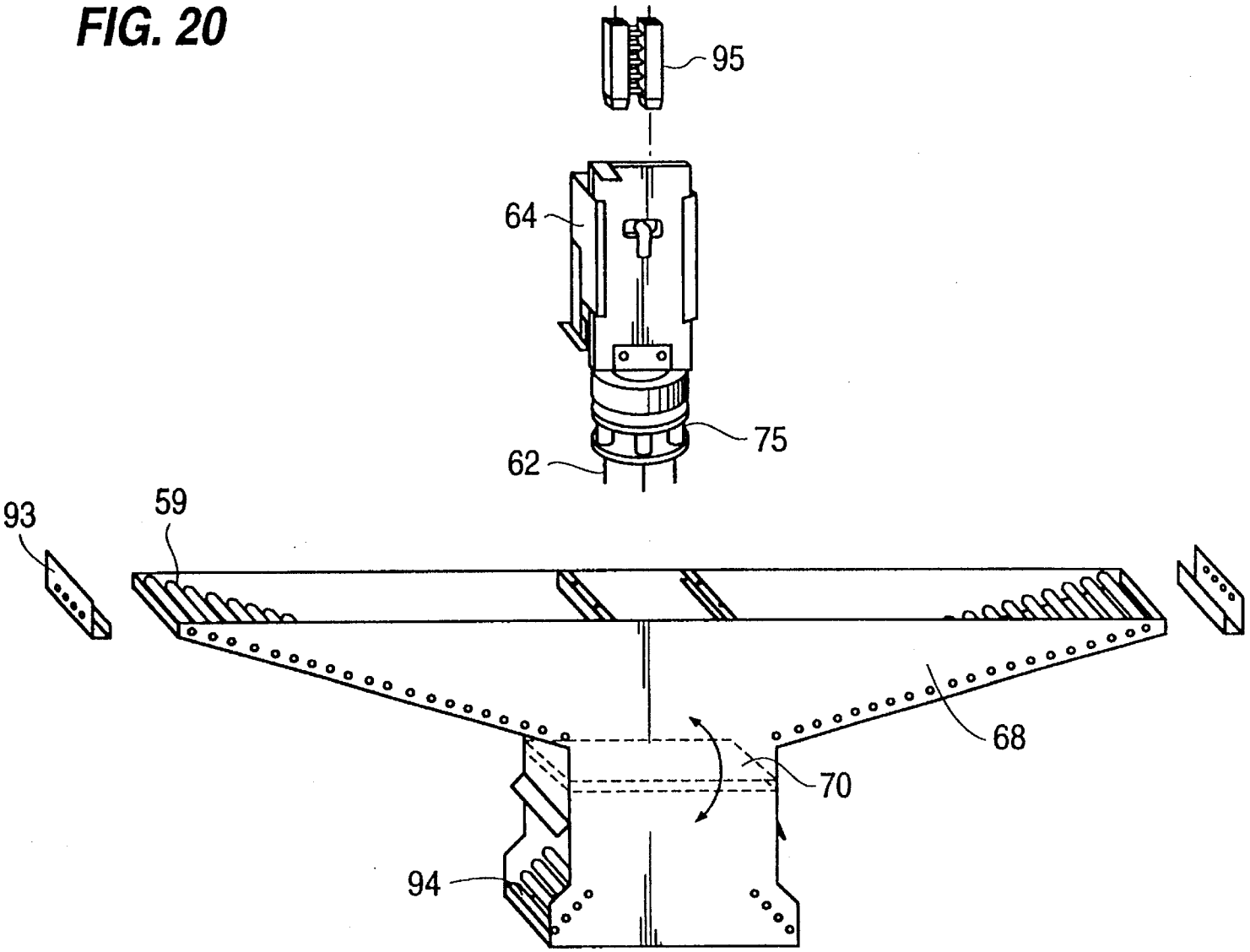
FIG. 20 is a schematic view of the chute which sets out the tilting tray and the perforating and sterilisation system.
Figure 21:
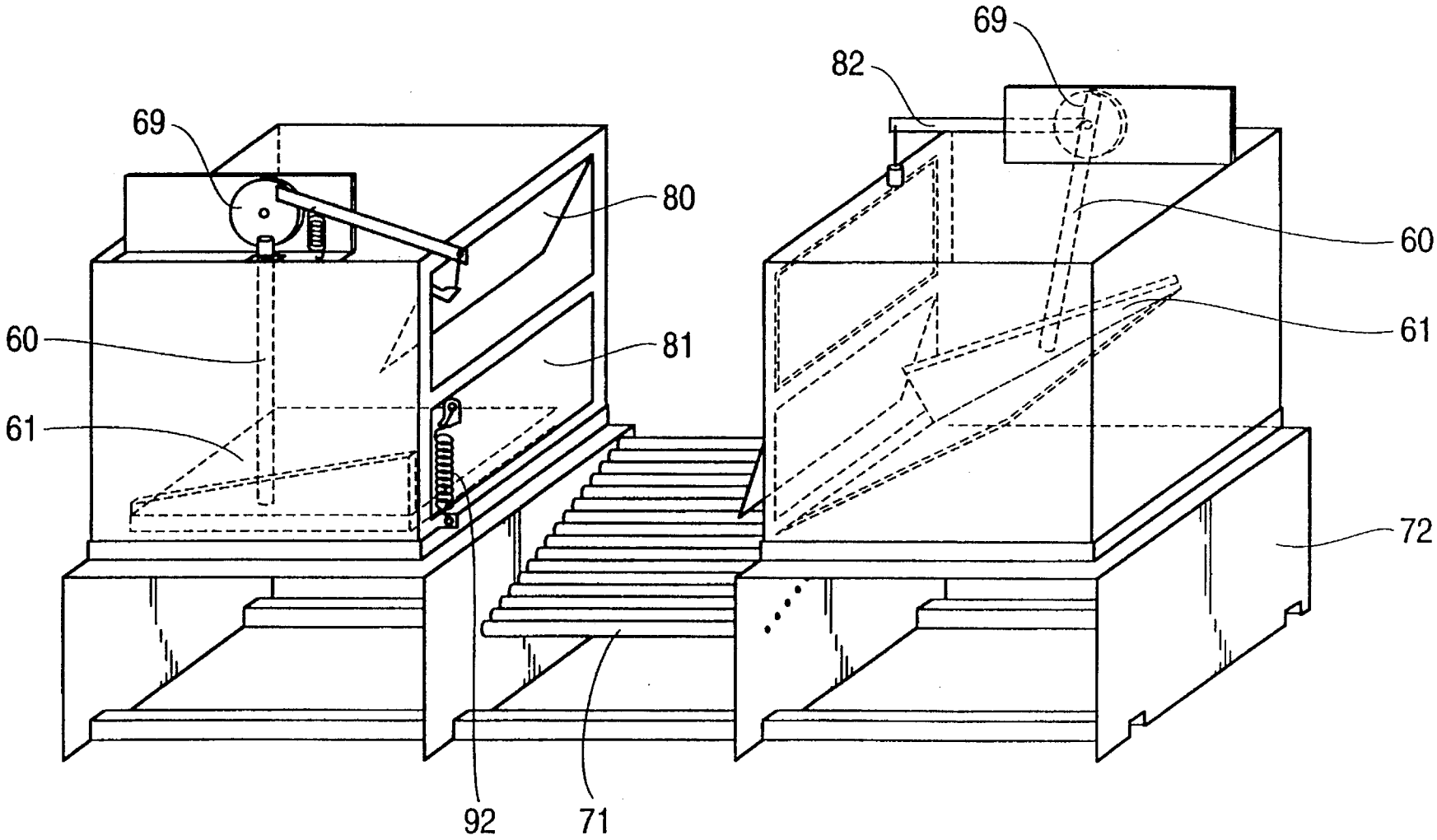
FIG. 21 is a perspective view of the microwave ovens setting out the movement of the access hatches, the tilting tray ejecting the commestible product out of the oven, the conveyor and the support of the microwave ovens.

FIGS. 18 and 19 set out the dispensation device of the columns 65 for stocking the commestible products 79. FIG. 19 is a diagram of a column 65. It particularly sets out the bar 78 which is a pivoting bar. This pivoting bar permits to liberate the front inlet of the column 65 for its loading with commestible products 79. In a closed position, the bar 78 permits to retain the commestible products one above the other in the column 65.

In the column 65, above the commestible products 79, a device 74 which avoids the fall of the last commestible product 79 of the column 65 is put in place.

The dispensation device of the storage column 65 ejects the commestible product 79 to be dispensed by means of an ejector motor for ejecting meals 66, located in the lower portion of the column 65. The belt of the ejector motor is provided with an index driving with it the commestible product 79.

Because of its simplicity, this dispensation device provided into the lower portion of the bottom of the storage and dispensation column 65 for the commestible products 79 is of a very simple operation.

In the middle portion of the dispenser, as shown in FIG. 18, a chute formed by transversal rolls is located under the dispensation columns 65 for collecting the commestible products 79 and guiding them on the tilting tray-chute 70 located between the two microwave ovens 90, 91. The perforating system 64 descends the needles 62 for perforating the package of the commestible product 79 and lifts them up in a stay position for sterilizing them by means of resistors 75.

The tilting tray-chute 70 tilts towards one of the microwave ovens 90 or 91 according to their disponibility. When motor 69 slightly rotates, the upper door 80 of the oven closes. The microwave oven 90 or 91 is put in operation during the heating time programmed according to the commestible product 79. At the end of this time, the motor 69 of the microwave oven 90 or 91 rotates until the oven tilting tray 61 provided with two axles in the front, at each side of the lower door 81, is tracted by the oven tray traction bar 60 attached on the crown driven by the motor 69, is tilted enough to push the lower door 81 of the oven 90 or 91 which was closed by the return spring 92, in order to evacuate the commestible product 79 on the conveying rolls 71 towards the receptacle for the consumer. The motor 69 goes on rotating until the oven tilting tray 61 of the oven 90 or 91 tracted by the oven tray traction bar 60 is returned to the horizontal and so, releases the lower door 81 of the oven 90 or 91, which is closed by the return spring 92. The motor 69 of the oven 90 or 91 rotates enough to operate the opening rod 82 that opens the upper door 80 of the microwave oven 90 or 91 to let the new selected commestible product 79 pass through.

Figure 22:
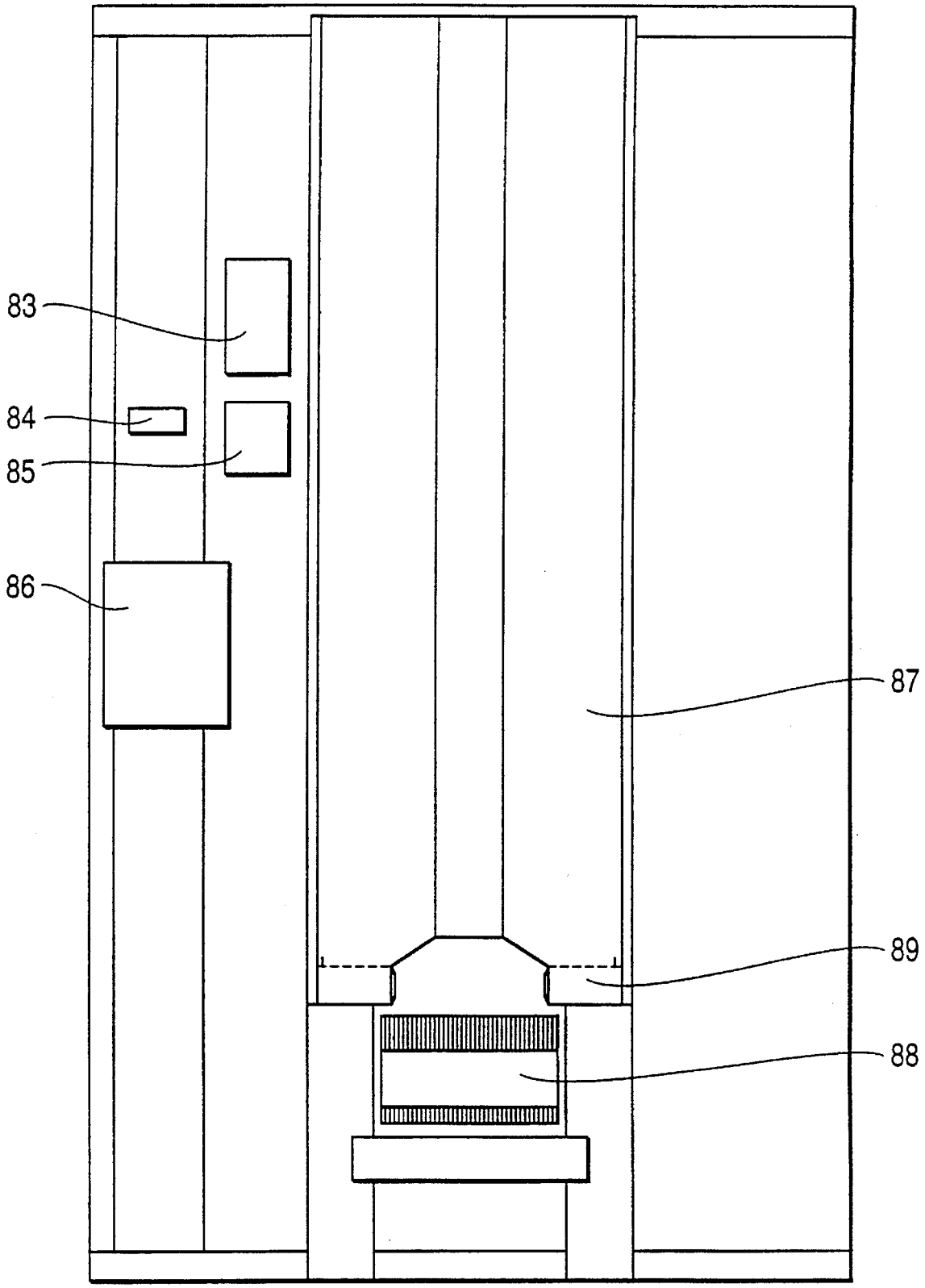
FIG. 22 is a schematic view of the door of the dispenser and it sets out the storage columns of the cutlery boxes and the receptacle.

FIG. 22 illustrates a door provided with a cutlery storage door 87, with motors 89 permitting to eject a cutlery box 97 into the receptacle 88 at each command of a commestible product.

REFERENCES

1 Dispenser
2 Frame
3 Front door
4 Hinge
5 Access window
6 Selection switch
7 Coin controler
8 Control screen
9 Modular cabinet
10 Upper part of frame
11 Dispensing column
12 Holding upper lugs
13 Holding lower lugs
14 Commestible product
15 Transversal bearing bars
16 Median part of frame
17 Hopper
18 hopper
19 Access hatch
20 Access hatch
21 Microwave ovens
22 Microwave ovens
23 Ejection slide
24 Ejection slide
25 Conveyor
26 Lower part of frame
27 Programmable automat
28 Cylinder driving access hatch
29 Cylinder driving access hatch
30 Inclined plane of the ejection slide
31 cylinder activating the ejection slide
32 cylinder activating the ejection slide
33 anti-break-in flap
34 pivoting bar
35 flap
36 rod means
37 counterweight
38 conveyor
39 index of the conveyor belt 38
40 hopper
41 transversal rolls
42 commestible products
43 inlet hatch
44 microwave oven
45 columns
46 housing of the cabinet
47 inverted cone, apex upward
48 microwave oven
49 horizontal hinge of the inlet hatch of the oven
50 hooks
51 scraper
52 outlet door of the oven
53 vertical hinge of the outlet door of the oven
54 bottom of the oven
55 perforating means of the packaging
56 articulated fingers
57 rotation axle of the perforating means
58 perforation needles
59 conveyor rolls
60 pulling bar of the tray of the oven
61 tilting tray of the oven
62 perforation needles
63 fan
64 perforating system
65 storage columns of the commestible products
66 ejection motor of the meals
67 support wedge of the meals
68 hopper formed by transversal rolls
69 multifunction motor of the microwave ovens
70 tilting tray of the hopper
71 conveyor rolls towards the receptacle
72 oven support
73 electric panel
74 wedge avoiding the rocking of the last meal
75 aseptization resistor of the needles
76 lock of the columns fixed by hinges
77 support hinge of the columns
78 holding rod of the meals
79 commestible products
80 upper door of the microwave oven
81 lower door of the microwave oven
82 rod for opening the upper door
83 basic electronic board
84 display device
85 interface board
86 coiner
87 cutlery storage column
88 receptacle

89 cutlery ejector
90 left microwave oven
91 right microwave oven
92 return spring of the lock of the oven lower door
93 support of the hopper
94 conveyor rolls towards the oven
95 motor of the perforting system
96 return spring of the lock of the oven upper door
97 cutlery box

I claim:

1. Automatic food dispenser (1), comprising:

a cabinet including storage columns (65) for storing commestible products (79);

at least two microwave ovens (90, 91);

a command and pay system; and a hopper (68) located under the storage columns (65) for collecting and routing the commestible products (79) via a tray-chute (70) to one of the microwave ovens (90, 91) according to a disponibility of said ovens.

2. Automatic food dispenser according to claim 1, characterized in that the hopper (40, 47) is constituted by transversal rolls (41) guiding the commestible products (42) towards an inlet hatch (43) of at least one microwave oven (44, 48).

3. Automatic food dispenser according to claim 1, characterized in that the inlet hatch (43) of the oven (44, 48) is of the box letter type with a horizontal hinge and a door hung to hooks (50) providing the opening of the door upon an impact of the commestible product (42) on the door after falling by gravity from the hopper (40, 47) and a automatic closing of said door caused by gravity.

4. Automatic food dispenser according to claim 1, characterized in that the ejection means (51) ejecting the commestible product (42) out of the oven (44, 48) is a scraper having a vertical wall that defines a corresponding space for receiving the commestible product (42), said scraper (51) being interdependant with the outlet door of the oven (52) with a vertical hinge (53).

5. Automatic food dispenser according to claim 1, characterized in that the microwave oven (44, 48) is provided with a perforating means (55) composed of articulated fingers (56) that perforate the packing of the commestible product (42).

6. Automatic food dispenser according to claim 1, characterized in that the cabinet frame comprises four double storage columns (65) under which is the hopper (68) providing an access to a tilting tray-hopper (70) on which the commestible products (79) are perforated by needles (62) that are asepticized by resistors (75); the tilting tray-hopper (70) providing an access to the microwave ovens (90, 91).

7. Automatic food dispenser according to claim 1, characterized in that the microwave ovens (90, 91) are provided with a tilting tray (61) which evacuates the commestible product (79) onto conveyor rolls (71) for conveying the commestible products in front of the access window for the consumer.

8. Automatic food dispenser (1), comprising:

a cabinet including storage columns (65) for storing commestible products (79);

at least two microwave ovens (90, 91);

a command and pay system; and at least one hopper (68) located under the storage columns (65) for collecting and routing the commestible products (79) via a tray-chute (70) to one of the microwave ovens (90, 91) according to a disponibility of said ovens;

wherein the food dispenser comprises modular cabinets (9) that are fixed to an upper portion of a casing frame (10) of the dispenser (1), said cabinets (9) being provided with lugs (12, 13) acting as supports for the storage columns, said storage columns being dimensionally adjustable for receiving the commestible products (14), said commestible products being delivered from said storage columns in a middle portion of the casing frame (16) of the dispenser, the hopper or hoppers located under the columns (11) collect the products (14) and route them above one or more access hatches (19, 20) to a microwave oven (21, 22); an ejection means of said microwave oven (21, 22) is an ejection slide (23, 24), a lower portion (26) of the casing frame of the dispenser comprises a programmable automaton (27), a control cabinet and output connectable by modem to a microcomputer for inventory management and after sale service.

9. Automatic food dispenser according to claim 8, characterized in that the modular cabinets (9) comprise two sets of four columns (11) facing each other, for a total of eight columns under which two hoppers (17, 18) providing an access to two microwave ovens (21, 22) are located.

10. Automatic food dispenser according to claim 8, characterized in that the access hatch (19, 20) is located in the upper portion of the microwave oven and is activated by a cylinder (28, 29).

11. Automatic food dispenser according to claim 8, characterized in that the microwave oven (21, 22) is provided with a bottomless slide (23, 24), the back wall of which is as a inclined plane for receiving the commestible products (14) falling from the access hatch (19, 20) and for acting as an ejection scraper when the slide activated by another cylinder (31, 32) partially exits out of the enclosure of the oven (21, 22) for ejecting said commestible product (14) on the conveyor (38).

12. Automatic food dispenser according to claim 8, characterized in that the access window (5) is provided with an anti-break-in flap (33) avoiding public access to the conveyors (25) and/or the microwave ovens (21, 22).

13. Automatic food dispenser (1), comprising:

a cabinet including storage columns (65) for storing commestible products (79);

at least two microwave ovens (90, 91);

a command and pay system; and a hopper (68) located under the storage columns (65) for collecting and routing the commestible products (79) via a tray-chute (70) to one of the microwave ovens (90, 91) according to a disponibility of said ovens;

wherein the microwave oven (44, 48) is provided with a perforating means (55) composed of articulated fingers (56) that perforate the packing of the commestible product (42); and wherein the perforating means (55) is composed of articulated fingers (56) interdependent with an axle (57) activated by an electromagnet and a spring, the fingers (56) being provided with at least one perforation needle (58) at their free ends.

14. Automatic food dispenser according to claim 13, characterized in that said fingers (56) are of different sizes and independant from each other to adapt to the different packing shapes.

15. Automatic food dispenser according to claim 13, characterized in that the perforating means (55) forms a hand the fingers (56) of which can be straight, of different lengths, and as seen from above, in a fan shape with the fingers open from each other in the last third portion of their length.

16. Automatic food dispenser (1), comprising:

a cabinet including storage columns (65) for storing commestible products (79);

at least two microwave ovens (90, 91);

a command and pay system; and a hopper (68) located under the storage columns (65) for collecting and routing the commestible products (79) via a tray-chute (70) to one of the microwave ovens (90, 91) according to a disponibility of said ovens;

wherein the hopper (40, 47) is constituted by transversal rolls (41) guiding the commestible products (42) towards an inlet hatch (43) of at least one microwave oven (44, 48); and wherein the hopper (40) is composed of a large cone open at its apex, downwardly oriented, and is terminated by another inverted cone (47), apex at the top, that dispenses the commestible products (42) either to the right oven (44), either to the left oven (48).

17. Automatic food dispenser (1), comprising:

a cabinet including storage columns (65) for storing commestible products (79);

at least two microwave ovens (90, 91);

a command and pay system; and a hopper (68) located under the storage columns (65) for collecting and routing the commestible products (79) via a tray-chute (70) to one of the microwave ovens (90, 91) according to a disponibility of said ovens;

wherein the lower portion of the dispenser comprises an electric panel (73); a door comprising two storage columns for storing cutlery (87) is provided with a cutlery ejector (89) for ejecting the cutlery towards a receptacle (88) for the consumer; a basic electronic board (83) is on an upper portion of the door; a display device (84) indicates how to do; an interface board (85) is near the coiner (86).

18. Automatic food dispenser (1), comprising:

a cabinet including storage columns (65) for storing commestible products (79);

at least two microwave ovens (90, 91);

a command and pay system; and a hopper (68) located under the storage columns (65) for collecting and routing the commestible products (79) via a tray-chute (70) to one of the microwave ovens (90, 91) according to a disponibility of said ovens;

wherein cutlery storage columns (87) eject cutlery boxes (97) by means of cutlery ejectors (89) into a receptacle (88).

19. An automatic food dispenser comprising a cabinet including commestible product storage columns, at least two microwave ovens, a command and pay system and a hopper located under the storage columns for collecting commestible products, characterized in that the automatic food dispenser further comprises a distributor means located under said hopper and receiving a selected commestible product therefrom, said distributor means being controllable for receiving a commestible product from the hopper, for routing the commestible product to one of said microwave ovens while passing through an open vertical side door of said one microwave oven, and for routing the commestible product to the other microwave oven by passing through another vertical side door of said other microwave oven.

20. An automatic food dispenser according to claim 19, including four double storage columns under which is said hopper.

21. An automatic food dispenser according to claim 19, wherein each said microwave oven includes a tilting tray which can be tilted for evacuating the commestible product towards a receptacle for taking off by a consumer.

22. An automatic food dispenser according to claim 19, further comprising a perforating system including needles for perforating a package of the commestible product when it is put on said distributor means.

23. An automatic food dispenser according to claim 19, further including columns for delivering a cutlery.

24. An automatic food dispenser according to claim 19, further including an access window which is provided with an anti-break-in flap for avoiding public access to the storage columns and/or the microwave ovens.

25. An automatic food dispenser according to claim 19, further including cutlery storage columns for ejecting cutlery boxes into said receptacle for taking off by a consumer.

26. An automatic food dispenser according to claim 19, wherein said distributor means is a cone (47) having an apex, said apex being oriented upright.

27. An automatic food dispenser according to claim 19, wherein said distributor means is a tray-chute which is controllable to take the following three selected positions:

a horizontal position for receiving a commestible product from the hopper;

a first tilted position for routing a commestible product to a first one of the microwave ovens; and a second tilted position for routing a commestible product to a second one of the microwave ovens.

* * * * *